US008727584B2

(12) United States Patent
Chen

(10) Patent No.: US 8,727,584 B2
(45) Date of Patent: May 20, 2014

(54) LED BULB STRUCTURE

(75) Inventor: Kuo-Chiang Chen, Hsinchu County (TW)

(73) Assignee: Lextar Electronics Corporation, Hsinchu (TW)

( * ) Notice: Subject to any disclaimer, the term of this patent is extended or adjusted under 35 U.S.C. 154(b) by 313 days.

(21) Appl. No.: 13/241,238

(22) Filed: Sep. 23, 2011

(65) Prior Publication Data

US 2012/0314426 A1 Dec. 13, 2012

(30) Foreign Application Priority Data

Jun. 8, 2011 (TW) ..... 100210394 U

(51) Int. Cl.
*F21V 29/00* (2006.01)

(52) U.S. Cl.
USPC ..... 362/373; 362/294

(58) Field of Classification Search
USPC ..... 362/373, 294
See application file for complete search history.

(56) References Cited

U.S. PATENT DOCUMENTS

| | | | | |
|---|---|---|---|---|
| 6,511,209 | B1 * | 1/2003 | Chiang | 362/294 |
| 2009/0046473 | A1 * | 2/2009 | Tsai et al. | 362/373 |
| 2010/0110691 | A1 * | 5/2010 | Hsu et al. | 362/294 |
| 2010/0126697 | A1 * | 5/2010 | Huang | 165/80.3 |
| 2010/0237782 | A1 * | 9/2010 | Horng et al. | 315/117 |

* cited by examiner

*Primary Examiner* — Julie Bannan
(74) *Attorney, Agent, or Firm* — CKC & Partners Co., Ltd.

(57) ABSTRACT

A LED (Light Emitting Diode) bulb structure includes a base, a plurality of fins and a shell. One end of the base is electrically connected to a power source, and the other end of the base is used for holding a LED light source. The fins are disposed on a surface of the base. The shell encloses the fins, and the shell includes a plurality of first heat-dissipation holes and a plurality of second heat-dissipation holes. The first heat-dissipation holes are arranged around the shell and corresponding to the fins for allowing airflow entering the first heat-dissipation holes to directly pass through each of the fins corresponding to each of the first heat-dissipation holes. The second heat-dissipation holes are arranged around the shell and disposed above the first heat-dissipation holes for enabling the first heat-dissipation holes and the second heat-dissipation holes to conduct thermal convection.

13 Claims, 3 Drawing Sheets

LED BULB STRUCTURE

RELATED APPLICATIONS

The application claims priority to Taiwan Application Serial Number 100210394, filed Jun. 8, 2011, which is herein incorporated by reference.

BACKGROUND

1. Technical Field

The present invention relates to a lighting device. More particularly, the present invention relates to a light bulb device.

2. Description of Related Art

A conventional light bulb uses tungsten as a light-emitting source, and has a simple structure and can be mounted and replaced conveniently. The tungsten light bulb structure generally has a spherical light cover of which a tail end is fixed to an adapter, wherein the adapter can be threaded into a normal bulb seat. When power is turned on, the tungsten inside the light cover will generate heat and emit light to achieve illumination purpose.

In recent years, since having the features such as small volume, low driving voltage, rapid response rate, aseismatic, long-lifted and environmentally friendly, a LED (Light-Emitting Diode) is used to replace the conventional light bulb. With the continuous development and advance of science and technology, the illumination efficiency of the LED not only has been greater than that of the tungsten bulb (which is around 10~201 m/W), but also has been greater than that of a fluorescent tube (which is around 60~801 m/W). In addition, with the current requirements of electronic products towards lightness and thinness, a LED bulb is used to replace the tungsten bulb gradually, and becomes a popular and widely used lighting device.

Generally speaking, the heat-dissipation efficiency of the LED bulb depends on the surface area of a heat-dissipation seat. The surrounding air can only conducts heat exchange on the surface of the heat-dissipation seat, and thus the heat-dissipation is slow and the efficiency thereof is limited, further affecting the work performance of the LED bulb. In order to allow the heat exchange between the heat-dissipation seat and air, a conventional design usually leaves the heat-dissipation seat uncovered. As such, the heat-dissipation seat is not pleasing to the eye, and the high temperature of the heat-dissipation is likely to burn a user and also causes safety concerns.

SUMMARY

According to one embodiment of the present invention, a LED (Light Emitting Diode) bulb structure includes a base, a plurality of fins and a shell. One end of the base is electrically connected to a power, and the other end of the base is used for holding a LED light source. The fins are disposed on a surface of the base. The shell encloses the fins, and the shell includes a plurality of first heat-dissipation holes and a plurality of second heat-dissipation holes. The first heat-dissipation holes are arranged around the shell corresponding to the fins for allowing airflow entering the first heat-dissipation holes to directly pass through each of the fins corresponding to each of the first heat-dissipation holes. The second heat-dissipation holes are arranged around the shell, and are disposed above the first heat-dissipation holes for enabling the first heat-dissipation holes and the second heat-dissipation holes to conduct thermal convection.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
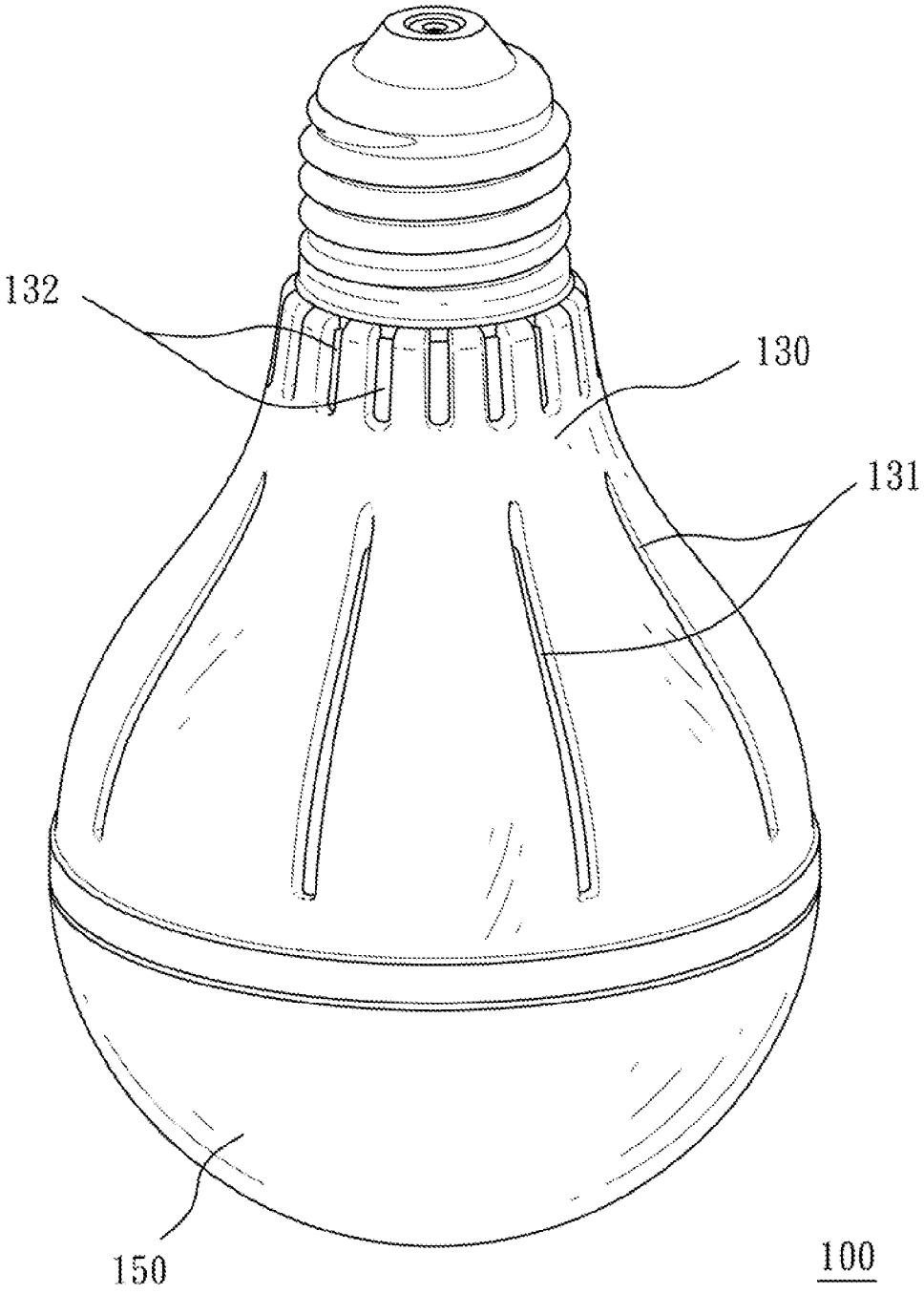
FIG. 1 is a three dimensional view of a LED bulb structure according to one embodiment of the present invention.
Figure 2:
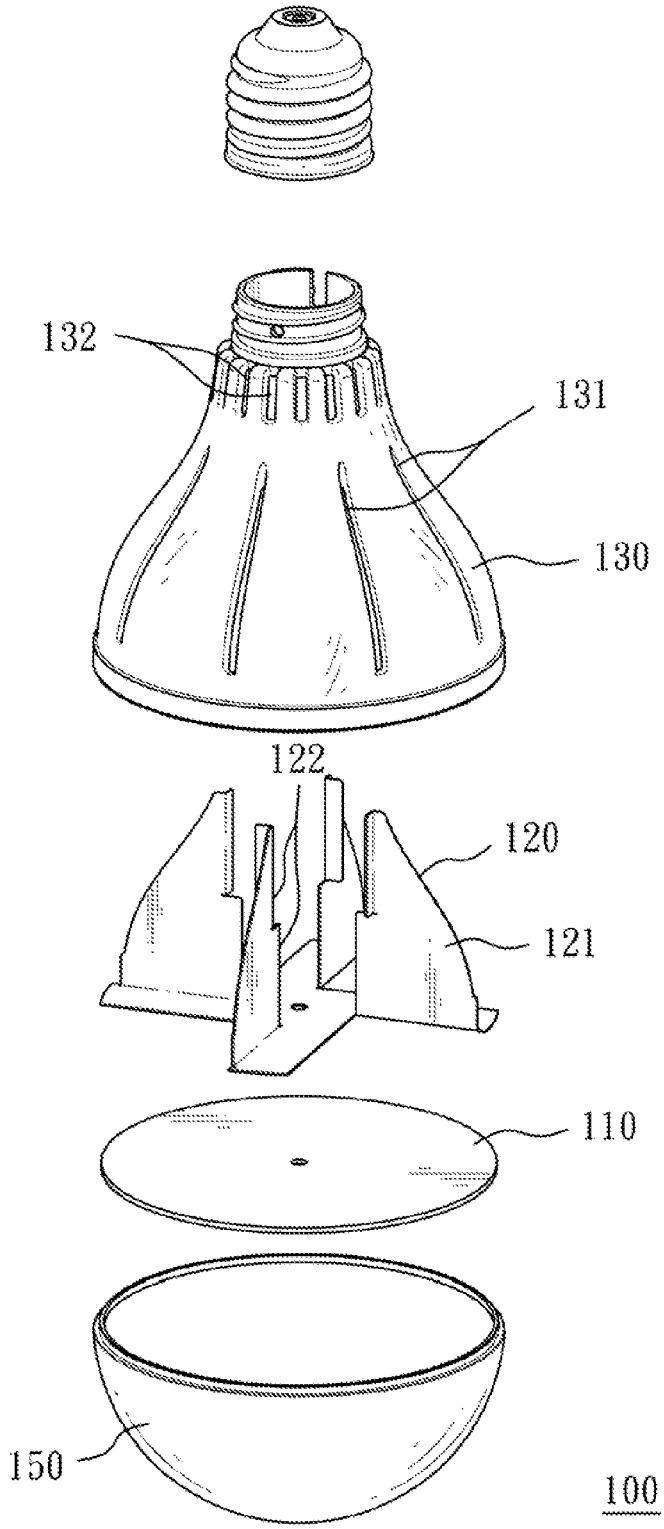
FIG. 2 is an exploded view of the LED bulb structure shown in FIG. 1.
Figure 3:
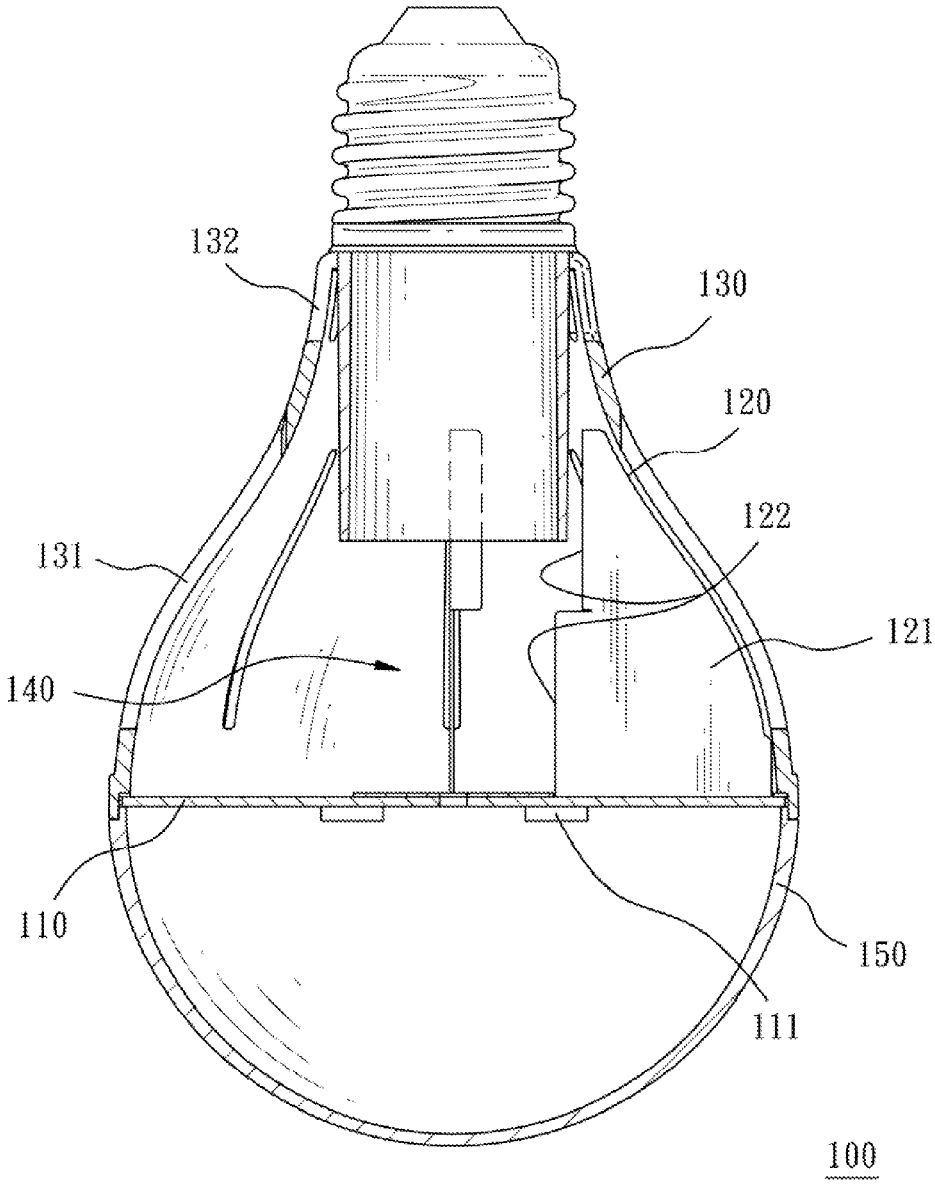
FIG. 3 is a cross-sectional of the LED bulb structure shown in FIG. 1.

FIG. 1 is a three dimensional view of a LED bulb structure according to one embodiment. FIG. 2 is an exploded view of the LED bulb structure shown in FIG. 1. FIG. 3 is a cross-sectional of the LED bulb structure shown in FIG. 1. As shown in FIG. 1 to FIG. 3, a LED (Light Emitting Diode) bulb structure 100 includes a base 110, a plurality of fins 120 and a shell 130. This present embodiment uses the shell 130 to enclose the fins 120 for solving the problems of appearance and safety.

One end of the base 110 is electrically connected to a power source, and the other end of the base 110 is used for holding a LED light source 111.

The fins 120 are disposed and arranged radially on a surface of the base 110. The fins 120 are formed in flat pieces. On the other hand, there are many options for the material of the fins 120, such as aluminum, magnesium, copper, ceramics, heat-dissipating plastic, graphite and their combinations. In the present embodiment, each of the fins 120 is substantially formed in a right triangle shape, and the reasons for choosing the right triangle shape will be described later.

The shell 130 encloses the fins 120. The contour of the shell 130 is substantially parallel to the entire contour of the fins 120, and a distance d to between the shell 130 and each of the fins 120 is about 1 mm. However, although the distance d is 1 mm in the present embodiment, yet it can range from 1 mm to 3 mm in other embodiments as well. The distance d can be adjusted according to the actual needs. Furthermore, the shell 130 is a bell-shaped shell. The shell 130 includes a plurality of first heat-dissipation holes 131 and a plurality of second heat-dissipation holes 132.

The first heat-dissipation holes 131 are arranged around the shell 130. There is no shape limitation to the first heat-dissipation holes 131. In the present embodiment, each of the first heat-dissipation holes 131 is an elongated hole. Moreover, the first heat-dissipation holes 131 are corresponding to the fins 120 for allowing airflow entering the first heat-dissipation holes 131 to directly pass through each of the fins 120 that are corresponding to the first heat-dissipation holes 131 respectively. The term "directly pass through" as used herein means that: after entering via the first heat-dissipation holes 131, airflow contacts the fins 120 directly without turning or making a detour for carrying heat away from the fins 120.

More particularly, in the present embodiment, each of the fins 120 has at least one heat-dissipation surface 121 which is parallel to the airflow entering each of the first heat-dissipation holes 131. Besides, each of the first heat-dissipation holes 131 is an elongated hole which can intake more air that will pass through the heat-dissipation surface 121 of each of the fins 120 for promoting heat-dissipating capability of the fins 120 on the LED light source 111.

In use, each of the fins 120 is substantially formed in a right triangle shape as described above, wherein a hypotenuse of the right triangle shape is corresponding to each of the first heat-dissipation holes 131. The hypotenuse is the longest side of the triangle, such that each of the fins 120 has a larger contact face with airflow for promoting heat-dissipation. Nevertheless, the shape of each of the fins 120 is not limited thereto, and thus any shape may have the same function as the fins 120 of the present embodiment, and will not depart from the spirit of the design.

The second heat-dissipation holes 132 are arranged around the shell 130 and are disposed above the first heat-dissipation holes 131 for enabling the first heat-dissipation holes 131 and the second heat-dissipation holes 132 to conduct thermal convection. The term "above" as used herein does not mean an absolute position but is viewed from the direction shown in FIG. 2 for the thermal convection. Generally speaking, a user may set the position of the LED bulb structure 100 as shown in FIG. 2. Since the hot air will go up, airflow enters the first heat-dissipation holes 131 and exits from the second heat-dissipation holes 132 after conducting thermal convection. Therefore, the present embodiment defines the second heat-dissipation holes 132 disposed above the first heat-dissipation holes 131. As Known from the foregoing, regardless of the direction of thermal convection or the setting position of the LED bulb structure 100, there is no need to have an extra airflow driven device but the thermal convection of the natural law can be used to achieve the heat-dissipation purpose.

Referring to FIG. 1, the first heat-dissipation holes 131 or the second heat-dissipation holes 132 are both arranged uniformly on the shell 130. In another embodiment, the first heat-dissipation holes 131 or the second heat-dissipation holes 132 can be arranged non-uniformly on the shell 130 as well. The air intake amount through the first heat-dissipation holes 131 is larger, because the aperture of the first heat-dissipation holes 131 is bigger, and the aperture of the second heat-dissipation holes 132 is smaller. In order to adjust the air intake and exhaust amounts, the amount of the second heat-dissipation holes 132 is more than that of the first heat-dissipation holes 131. Averagely, every two second heat-dissipation holes 132 are corresponding to one first heat-dissipation hole 131.

Referring to FIG. 2, specifically speaking, the fins 120 form a cooling space 140 inside the shell 130, wherein the cooling space 140 provides a smooth path for the airflow entering the first heat-dissipation holes 131 to move towards the second heat-dissipation holes 132, thereby solving the problem of airflow turbulence and heat stagnation, further promoting thermal convection efficiency of the first heat-dissipation holes 131 and the second heat-dissipation holes 132. In addition, in the present embodiment, one side of each of the fins 120 near the cooling space 140 is designed to a step-shape 122, wherein the step-shape 122 has the airflow-guided efficacy and also can has the effects of reducing airflow turbulence and heat stagnation.

Furthermore, the present embodiment further includes a lamp cover 150 connected to the shell 130. The lamp cover 150 can protect the LED light source 111 on one hand, and on the other hand, it can make the light uniformly emitted by its special design. For instance, various lines can be designed on the lamp cover 150 to enhance visual appearance. In addition to design of lines on the lamp cover 150, the color of the lamp cover 150 also can be changed to meet the needs of the user.

According to the aforementioned embodiments, the LED bulb structure 100 is not only pleasing to the eye but also is safe. Moreover, the airflow entering the first heat-dissipation holes 131 directly passes through each of the fins 120 that are corresponding to the first heat-dissipation holes 131 respectively, and thus the thermal convection between the first heat-dissipation holes 131 and the second heat-dissipation holes 132 can achieve the heat-dissipation purpose without needing to install extra airflow driven devices. Finally, the cooling space 140 and the step-shape 122 both can reduce the occurrence of airflow turbulence and heat stagnation.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A LED (Light Emitting Diode) bulb structure, comprising:

a base, wherein one end of the base is electrically connected to a power source, and the other end of the base is used for holding a LED light source;

a plurality of fins disposed on a surface of the base; and a shell enclosing the fins, the shell comprising:

a plurality of first heat-dissipation holes arranged around the shell and each of the fins is aligned with at least a corresponding one of the first heat-dissipation holes for allowing airflow entering the first heat-dissipation holes to directly pass through each of the fins corresponding to each of the first heat-dissipation holes; and a plurality of second heat-dissipation holes arranged around the shell and disposed above the first heat-dissipation holes for enabling the first heat-dissipation holes and the second heat-dissipation holes to conduct thermal convection.

2. The LED bulb structure of claim 1, wherein each of the fins has at least one heat-dissipation surface which is parallel to the airflow entering each of the first heat-dissipation holes.

3. The LED bulb structure of claim 1, wherein a distance between the shell and each of the fins ranges from 1 mm to 3 mm.

4. The LED bulb structure of claim 1, wherein each of the fins is substantially in a right triangle shape, and a hypotenuse of the right triangle shape is corresponding, to each of the first heat-dissipation holes.

5. The LED bulb structure of claim 1, wherein each of the first heat-dissipation holes is an elongated hole.

6. The LED bulb structure of claim 1, wherein the fins are arranged radially on the surface of the base.

7. The LED bulb structure of claim 1, wherein the shell is a bell-shaped shell.

8. The LED bulb structure of claim 1, wherein the fins form a cooling space inside the shell for promoting thermal convection efficiency of the first heat-dissipation holes and the second heat-dissipation holes.

9. The LED bulb structure of claim 8, wherein one side of each of the fins near the cooling space is distributed in a step-shape.

10. The LED bulb structure of claim 1, wherein the first heat-dissipation holes are arranged non-uniformly on the shell.

11. The LED bulb structure of claim 1, further comprising:

a lamp cover connected to the shell.

12. The LED bulb structure of claim 1, wherein each of the second heat-dissipation holes is disposed farther from the base than any portion of each of the fins.

13. The LED bulb structure of claim 1, wherein each of the fins substantially in a right triangle shape, and a hypotenuse of the right triangle shape has a length that is generally equal to a length of each of the first heat-dissipation holes.

* * * * *